United States Patent [19]

Cavalleri

[11] Patent Number: 4,923,377

[45] Date of Patent: May 8, 1990

[54] SELF-MACHINING SEAL RING LEAKAGE PREVENTION ASSEMBLY FOR ROTARY VANE DEVICE

[76] Inventor: Robert J. Cavalleri, 1605 Gran Via, Orlando, Fla. 32825

[21] Appl. No.: 245,450

[22] Filed: Sep. 16, 1988

Related U.S. Application Data

[63] Continuation-in-part of Ser. No. 95,106, Sep. 11, 1987, abandoned.

[51] Int. Cl.[5] ..... F04C 18/344; F04C 27/00; F04C 29/02; F16J 15/28

[52] U.S. Cl. ..... 418/98; 418/144; 277/1; 277/81 P; 277/DIG. 6

[58] Field of Search ..... 418/98, 142, 144; 277/1, 81 P, 224, DIG. 6

[56] References Cited

U.S. PATENT DOCUMENTS

| | | | |
|---|---|---|---|
| 302,316 | 7/1884 | Beystrum | 418/144 |
| 902,239 | 10/1908 | Lee | 418/144 |
| 1,972,744 | 9/1934 | Lister | 418/144 |
| 4,521,167 | 6/1985 | Cavalleri et al. | 418/82 |

FOREIGN PATENT DOCUMENTS

| | | | |
|---|---|---|---|
| 20691 | 12/1956 | Fed. Rep. of Germany | 418/144 |
| 1451698 | 3/1970 | Fed. Rep. of Germany | 418/144 |
| 57-41489 | 3/1982 | Japan | 418/144 |
| 59-229085 | 12/1984 | Japan | 418/98 |
| 19647 | 5/1899 | Switzerland | 418/144 |

*Primary Examiner*—John J. Vrablik
*Attorney, Agent, or Firm*—Julian C. Renfro

[57] ABSTRACT

A low internal leakage, rotary vane gas compressor utilizing a housing having a generally elliptical cavity, whose outer boundary is defined by an inner stator wall. A shaft mounted rotor is disposed offset from the central axis of the cavity, with an end plate secured on each end of the housing. Each end plate has a centrally mounted hole for rotatably supporting the respective side of the rotor shaft. The housing has inlet and discharge passages, each in conact with the cavity. The rotor has a plurality of radial slots in equally spaced relation about its periphery, in each of which slots a slidable vane of minimal weight is disposed. Each vane is approximately the width of the rotor, and the outer tip of each vane is in close proximity to the inner stator wall. These vanes define a plurality of chambers which undergo significant volume changes during rotation of the rotor. The vanes thus cooperate with the inner stator wall and the end plates to compress gas entering the inlet passage, such that the gas thereafter leaving through the discharge passage is at a higher pressure. Advantageously, a seal ring of particularly hard, tough steel is mounted in each end plate, and biased into contact with the respective side of the rotor to effect an essentially zero gap therewith. Each seal ring has a tapered cross section, such that the initial footprint area is small, but with rotor wear, the small contact area desirably becomes a surface contact.

15 Claims, 3 Drawing Sheets

FIG 3
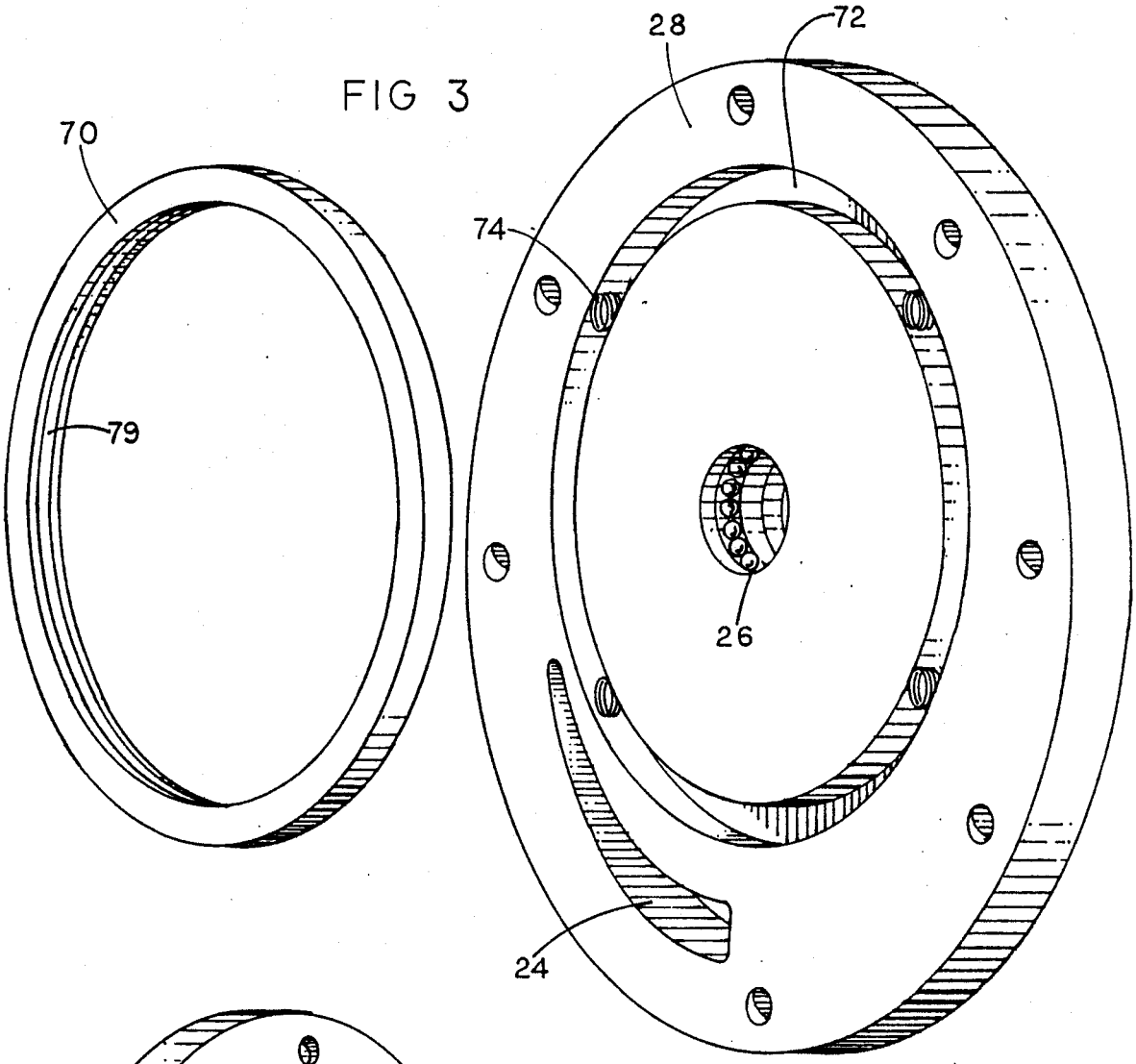
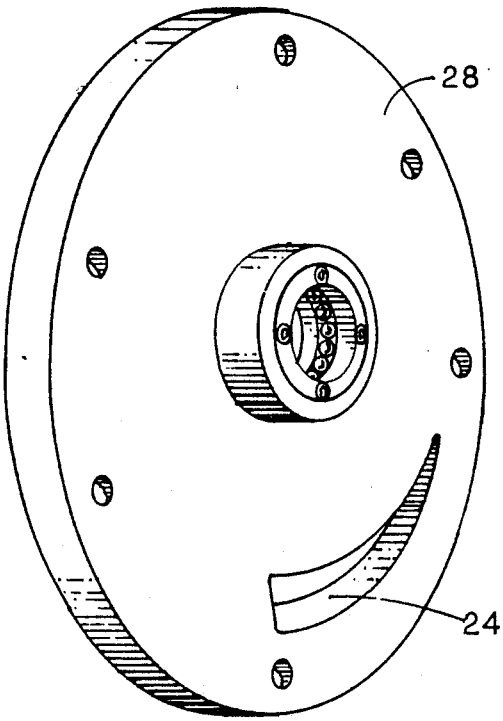
FIG 4A
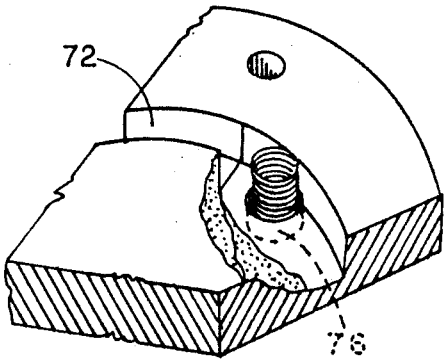
FIG 4B

SELF-MACHINING SEAL RING LEAKAGE PREVENTION ASSEMBLY FOR ROTARY VANE DEVICE

RELATIONSHIP TO PREVIOUS INVENTION

This is a Continuation-in-Part of my application entitled "Low Internal Leakage Rotary Gas Compressor," Ser. No. 95,106 filed Sept. 11, 1987, now abandoned, and it is also based in general upon the device forming the subject matter of U.S. Pat. No. 4,521,167, which issued to Robert J. Cavalleri and William E. Clark on June 4, 1985, bearing the title "LOW FRICTIONAL LOSS ROTARY VANE GAS COMPRESSOR HAVING SUPERIOR LUBRICATION CHARACTERISTICS."

BACKGROUND OF THE INVENTION

In the past several decades, there has been an interest in sliding rotary vane gas compressors, the interest in these devices being attributable to several factors, including their basic simplicity, comparatively low manufacturing and installation costs, and relatively high volumetric displacement.

These devices have typically involved a rotor containing a plurality of generally radial slots, which slots are disposed in spaced relation about the periphery of the rotor. Such rotor is mounted on a shaft, and disposed in a housing having either a circular or an elliptically shaped cavity. A slidable vane is disposed in each such slot, with these vanes being caused to move outwardly under the influence of centrifugal force at such time as power is applied to the rotor shaft. The outer tips of these vanes are intended to contact the inner walls of the generally elliptically shaped stator cavity and make sealing contact therewith.

As is obvious, the combination of vanes and sidewall is such that a plurality of chambers are in effect defined in the stator cavity, which chambers are constantly changing their respective configurations during rotor rotation. Thus, by providing an inlet in the stator at a location where a given chamber is enlarging, a charge of gas to be compressed can be taken in. Then, during continued rotation of the rotor, this charge of gas is thereafter compressed as the generally elliptically shaped sidewall causes the respective vanes to move inwardly, to decrease the chamber size. By placing one or more exit ports or discharge ports at the location where each chamber has been caused to become quite small, gas under relatively high pressure can be delivered.

Unfortunately, prior art rotary vane gas compressors suffered from several distinct disadvantages, such as high power penalties, and rapid wear at the tips of the vanes because of high loading, this usually being accompanied by insufficient lubrication.

Although the previous design in accordance with the teaching of U.S. Pat. No. 4,521,167 was highly effective and fully functional, nevertheless, it is a fact that should the bearings be even slightly misplaced or displaced from the true centers of this device, this had the tendency to cause the rotor to be even very slightly cocked and therefore displaced from a true and highly desirable circularly perfect orbit. This non-circular orbit prohibits the side of the rotor from rotating in a perfectly flat plane, which results in an undesirable variable height leakage path between the rotor and the end plate. Typical oil film thicknesses are on the order of 0.0005 inches for applications of this nature. Therefore, clearances of 0.0005 inches or greater can cause excessive internal gas leakage, unless the compressor so to speak is "flooded" with lubricating oil. The expense to hold assemblies to tolerances such as 0.0005 inches is increased, however, when hand fitted procedures are required.

With our original design, any ill-fitting aspects of our device tended to decrease volumetric efficiency, and thereby to invite an undesired radial flow of gas.

Accordingly, I have been motivated to provide a vastly superior rotary vane compressor design and sealing arrangement such that internal leakage as a result of manufacturing discrepancies is greatly decreased without any degradation of the power input.

SUMMARY OF THIS INVENTION

In accordance with a preferred embodiment of my rotary vane gas compressor, I have provided means in each end wall for locating a sealing ring to create a highly advantageous seal between the rotor side wall and the ring, with the objective being to eliminate internal gas leakage between the rotor and the pair of end plates or walls.

The sealing rings on the left and on the right sides of the chamber are actually located in recessed circular slots in the respective end plates of the device. These rings are of particularly hard, tough steel, and are spring loaded so as to keep pressure against the two sides of the rotor, thereby giving an essentially zero leakage path between adjacent chambers and chambers that are diametrically opposed. The rings preferably have a tapered cross section so as to have an initially small footprint area, but with rotor wear, an increased surface contact area developes.

Although the device taught and claimed in the Cavalleri and Clark U.S. Pat. No. 4,521,167 operated in a highly advantageous manner, it required precision hand fitting assembly techniques in some instances, which led to high production costs. This has been obviated by the use herein of the new sealing rings.

The rings extend above the end wall face by typically only 0001 to 0005 inches at most and the preferred extension is on the order of 0.002 inches. The ring height is on the order of 0.250 inches. These dimensions therefore preclude the possibility of the spring or ring from becoming dislodged during operation.

Other significant aspects of my invention involve retention of the means to minimize the radial vane load due to a pressure imbalance between the vane base and vane tip. This reduced load decreases the load capacity requirements of the vane tip oil film, and constrains the vane from contacting the stator surface.

Significantly, I entirely eliminate the need for springs utilized to bias the vanes outwardly, in accordance with the teachings such as set forth in the U.S. patent to Cassidy, Pat. No. 3,820,924.

Additionally, I minimize wear and friction by a refinement of the tips of the vanes. I preferably utilize vane tips created by the use of two different radii, thus resulting in outstanding wear qualities as well as substantial minimization of friction.

It is therefore a primary object of the present invention to improve upon the original Cavalleri and Clark design by providing at relatively low cost, a highly effective sealing ring to be utilized in the end plates on each side of the rotor, so as to make it possible for my new device to be assembled in accordance with mass production techniques, rather than having to be hand crafted. Each sealing ring is spring loaded, thus preventing a leakage flow tending to take place in a radial direction on either side of my device.

Most advantageously, my new design makes this improved device much more produceable at a reasonable cost, because by the use of the spring loaded seals, no painstaking hand fitting is involved, and production components can be readily fitted together in a nonleak fashion. Being mindful of the undesirable leakage paths which tended to be established in some instances in our earlier machine, we found that one alternative for the elimination of these leakage paths was, so to speak, to flood the machine with lubricating oil in order to effect a fluid seal. We thereafter found, however, that the use of excessive oil was undesirable, for the fluid seal does not permit a 100% effective seal, inasmuch as the oil can be displaced by the internal flow of gas.

As another alternative, we had taken the step in our earlier design of adding an abradable sealant to all the internal parts of our device, including rotor, stator and end plates. Unfortunately, however, while this abradable material for a period of time improved volumetric efficiency, it nevertheless could not be expected to hold up for the life of the machine. Furthermore, the use of abradable sealant can still result in an undesirable internal leakage, if the mating parts (rotor and side plates) are badly misaligned.

Accordingly, it is another important object of my invention to provide a rotary vane gas compressor whose volumetric efficiency is much higher than was possible in accordance with our earlier design, and which high volumetric efficiency can be expected to hold up for the life of the machine.

Still another important object of the present invention is to provide a self-machining seal ring leakage prevention assembly utilized on each side of the rotor, with each seal ring having a tapered cross section and being made of very hard, tough steel, such that with rotor wear, a very close fitting surface contact is developed.

My novel tapered sealing rings advantageously function to cause any line contact due to fabrication tolerance stack up or assembly misalignment to evolve to surface, contact as the sealing ring, which acts as a cutting tool, wears a flat groove in the rotor side where the sealing ring makes contact with it.

Yet another object of my invention is to effect a surface sealing region rather than a line sealing region between the discharge chamber and the suction chamber.

Yet still another object of my invention is to provide a rotary vane compressor wherein lubrication of the vanes is easily and efficiently accomplished and wherein the displacement of the compressor is large relative to its size and its number of vanes.

Still another object of my invention is to provide a rotary vane compressor wherein a pressure balance existing between the vane tip and the vane base is such that vane life as well as stator life is greatly extended.

Still another object is to provide a compressor having vanes whose tips form a highly advantageous compound contour.

Other objects, features and advantages of this invention will be more apparent as the description proceeds.

BRIEF DESCRIPTION OF THE DRAWINGS

FIG. 3 is a perspective view showing the interior of an end plate or end wall, and one of my novel sealing rings in exploded relation thereto;

FIG. 4A is a view of the exterior of an end plate, revealing the use of bearings at its central portion, as well as an inlet port;

FIG. 4B is a fragmentary view revealing to a large scale, a typical spring as utilized in its recess located in the circular groove created to receive a novel sealing ring;

DETAILED DESCRIPTION

Figure 1:
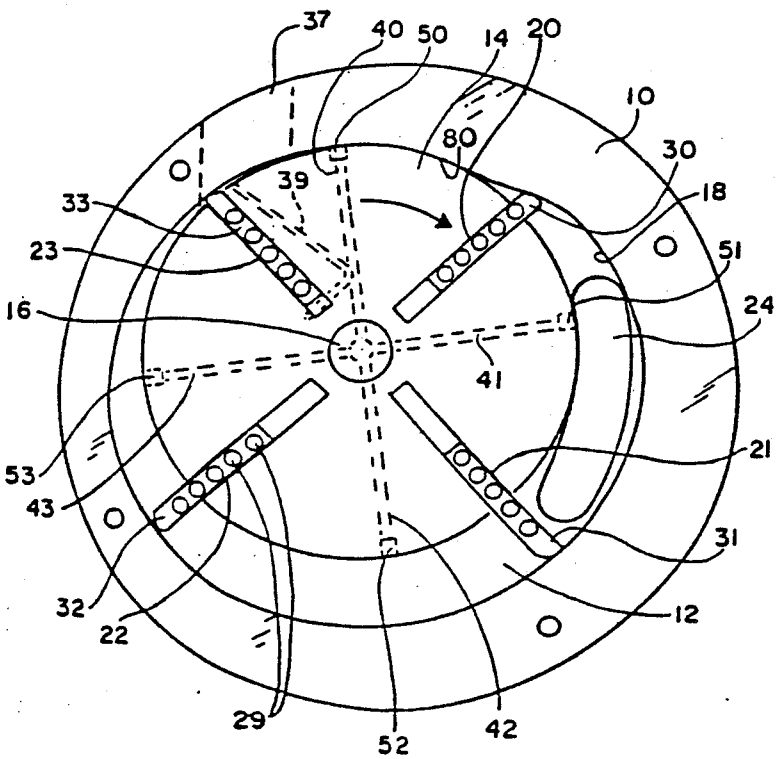
FIG. 1 is a cross sectional view of my novel compressor, taken so as to reveal the rotor, the end of the rotor shaft, the elliptical cavity in which the rotor is disposed, the sliding vanes of the rotor, and the new transition section utilized to diminish the potential leakage path between inlet and outlet.

Referring to FIG. 1, I have there shown an exemplary version of my invention, involving a stator housing 10, in which is defined a generally elliptically shaped cavity 12. I use the term "generally elliptically" to include circular. Disposed in this cavity is a circular rotor 14, fixed upon a rotatable shaft 16. The rotor contains a plurality of slots disposed at spaced intervals about its periphery. In this preferred embodiment, I utilize four radially disposed slots, 20, 21, 22 and 23, in which are located slidably disposed vanes 30, 31, 32 and 33, respectively.

The inner stator wall 18 of the stator cavity is the surface contacted by the outer tips of the vanes during rotation of the rotor, and thus forms the outermost radial boundary for the gas that is to be pumped. The outer periphery of the rotor forms the innermost boundary, and the end plates 27 and 28, one located on each side of the stator housing 10, form the axial boundaries for the compressor. These end plates are best seen in FIG. 2, and they are held together in the proper working relationship by a series of bolts 19 passing through aligned holes in the end plates and the stator.

In the preferred embodiment, the device is configured as a single stage pump or compressor, and the geometric center of the rotor/shaft assembly is offset upward and to the left (for clockwise rotation) from the geometric center of the inner stator wall 18 of the cavity 12, as is conspicuous in FIG. 1. This offset is typically on the order of a few percent of the rotor radius, and is sufficient to cause a volume of gas entering through a suitable inlet port 24, and trapped between two adjacent vanes, to vary as the shaft is driven in rotation by a motive force (not shown).

Figure 2:
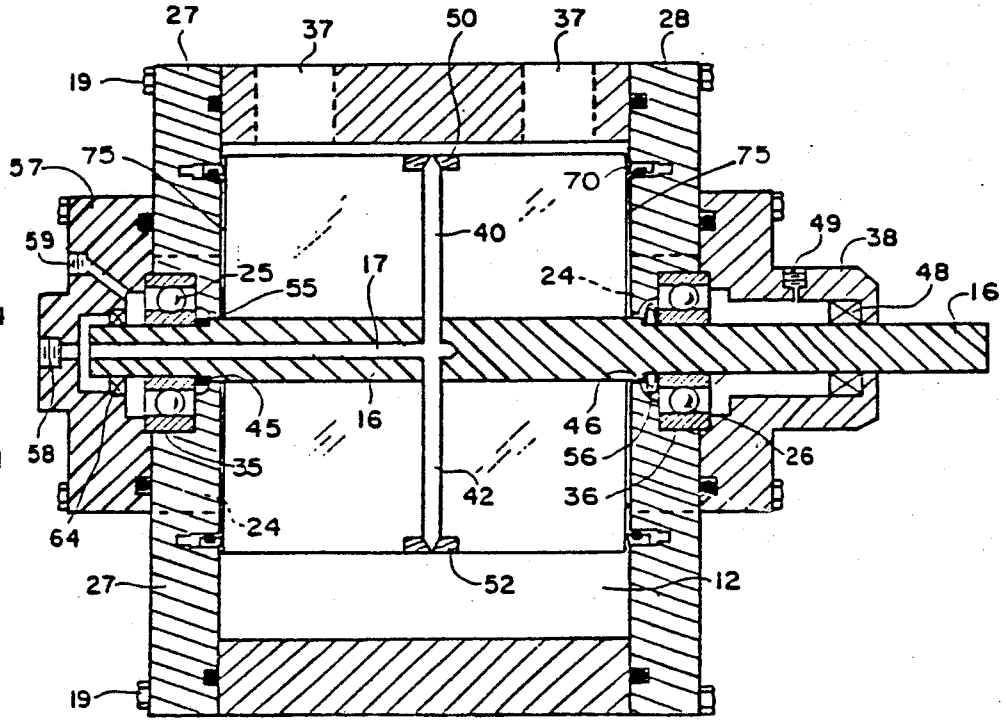
FIG. 2 is a cross sectional view taken along the length of the rotor shaft, with this view revealing the end walls of the compressor stator, the bearing and shaft details, the rotor end plate gap, and quite importantly, the new sealing rings utilized with this new embodiment.

FIG. 1 reveals that each inlet port 24 may be created to extend for a substantial but nevertheless limited angular extent, and FIG. 2 reveals that two ports or passages 24 are preferred, one in each of the end plates 27 and 28. As the rotor 14 is driven in rotation, clockwise in this instance as viewed in FIG. 1, the vanes 30–33 are driven outwardly under the effect of centrifugal force, with the tips of the vanes in close proximity to the inner stator wall 18 of the cavity 12. I mean by the words "close proximity" that the vane tips are riding on a film of lubricant coating the inner stator wall 18.

Gas entering through the inlet ports 24, one of which is shown in some detail in FIG. 4A, is thereafter compressed during continued rotor rotation, as the chambers defined by each adjacent pair of vanes are caused to diminish in volume. Ultimately the compressed gas exits from the cavity 12 through exit ports 37, which are visible in FIGS. 1 and 2. I prefer to use two inlet ports and two outlet ports, each of limited angular extent, but I am not to be limited to these numbers.

It is important to note that FIG. 1 reveals a significant modification of the original Cavalleri and Clark device patented on June 4, 1985, this being the utilization of a transition section 80, located between the outlet 37 and the inlet 24. This transition section is created on a concentric radius from the centerline of the rotor, and the section 80 extends for a nominal length, such as for one-half inch or greater. Thereafter the section 80 extends smoothly into the basic ellipse, so as to define the remaining portion of the inner stator wall. In a manner of speaking, therefore, the inner stator wall in the vicinity of the inlet 24 is essentially of the same configuration as revealed in the original Cavalleri and Clark design.

Thus it is to be seen that the housing interior of the instant invention is no longer a pure ellipse, as was the case in U.S. Pat. No. 4,521,167, for the use in accordance with the present invention of the previously-mentioned transition portion 80 near the outlet port serves to define an improved travel path for the tip of each vane, thus making it possible to significantly decrease the possibility of leakage between outlet and inlet, along the internal stator wall.

It is to be realized that the utilization of the transition section 80 serves very effectively to convert from line contact to an area contact between the rotor and stator, thus diminishing the possibility of a leakage path for compressed gas, from outlet to inlet, along the interior of the housing.

As will be set forth at length hereinafter, I have made it possible to greatly lessen the internal leakage, and therefore to enhance the output and efficiency of the pumping action that is achieved in accordance with this invention. In FIG. 2 I illustrate the use of a sealing ring 70 in each of the end plates 27 and 28, which rings are precisely fitted in circular slots 72 cut in the respective end plates, as will hereinafter be discussed.

It will be apparent to those skilled in the art that during rotation of the rotor and shaft assembly, there is a tendency for gas to leak internally between chambers and from the discharge chamber to the suction chamber through the rotor end wall gap 75, visible in FIG. 2. It was to overcome the potential leakage path between the high pressure or discharge side of the compressor, and the low pressure or intake side of the compressor that I have utilized the new sealing rings 70.

Advantageously, the new sealing rings are made of very hard, tough steel, whereas the rotor does not necessarily possess the same degree of hardness and toughness.

Figure 6A:
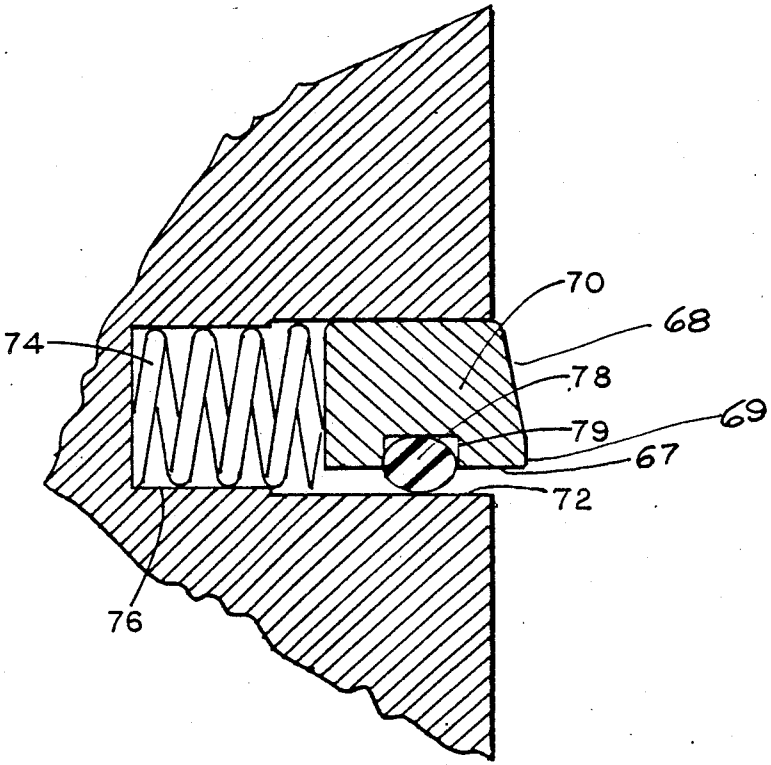
FIG. 6A is an in place enlarged fragmentary view revealing the relationship of spring, sealing ring and O-ring in the circular groove of the end plate.
Figure 6:
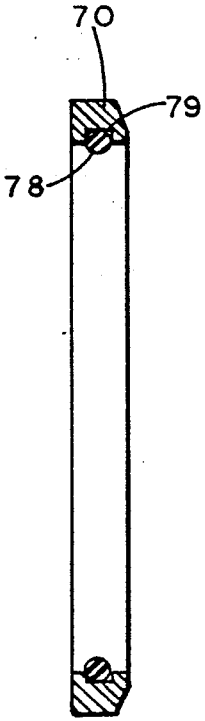
FIG. 6 is an edge view of a typical sealing ring used in an end plate in accordance with this invention.

In FIG. 3 I depict in the end plate 28, a circular slot 72 in which the ring 70 is received. The active portion of each sealing ring is tapered as shown in FIG. 6A, and the angled face 68 and the short, flat fate 69 intersect at an obtuse angle. Surface 68 is typically the longer surface. The short, flat surface 69 acts as a cutting tool and wears a flat, parallel surface in the rotor side. The taper on the seal ring does not have a sharp (acute) angle, which would have been created at the intersection of surfaces 68 and 67 if surface 69 were omitted. The utilization of an acute angle at location 69 would have resulted in line contact and not surface contact, and would also have led to too much rotor wear before a sufficient amount of surface contact reduces the cutting load to the point where the rotor no longer has any appreciable wear at this location. Other details of the ring and slot relationships are visible in FIGS. 5, 6, and 6A. It is clearly within the spirit of this invention to locate the flat face 69 and the O-ring 78 on the outside diameter of the sealing ring, if this alternate construction for any reason is desired.

It is to be realized that in a period of a relatively short time of rotation, my device actually tends to wear-in, in a manner of speaking, in that the relatively hard seals 70, under the bias provided by the plurality of springs 74, will actually generate a flat seat in the near edge of the rotor if, indeed, such a seat did not initially exist or if high spots existed, and by this wear-in process, the already high resistance to leakage path will be further increased. Thus it may be said that my novel sealing rings have a self-machining characteristic in that in a relatively short amount of running time, they bring about a highly desirable surface contact with the rotor sidewalls. Each spring is received in its respective recess 76, which recesses are symmetrically placed about the slot 72. Details of the spring and recess relationships are to be seen in FIGS. 4B, 5, and 6A.

Although I am not limited to the use of large diameter sealing ring, I have nevertheless found it highly advantageous to make the ring on each side of the rotor as large a diameter as reasonably possible for this serves to minimize the opportunity for leakage-flow between adjacent chambers of my device, each chamber being defined between the stator and the rotor and any one adjacent pair of vanes.

A preferred configuration for applying controlled quantities of lubrication is through spray nozzles 50, 51, 52, and 53 located in the rotor 14, as shown in FIGS. 1 and 2. These nozzles are attached at the outlets of oil passages 40, 41, 42, and 43 respectively, that are radially disposed in rotor 14, and each spray nozzle has a flat wide spray pattern that extends between both end plates 27 and 28. Oil is supplied to the oil passages and respective spray nozzles from a long axial passage 17 formed in rotor shaft 16, as best shown in FIG. 2. Each nozzle is located close enough to the respective vane leading edge that sufficient oil is maintained at the vane stator interface for hydrodynamic lubrication and for sealing.

The generally elliptical stator housing inner stator wall 18 thus effectively serves as a cam for the motion of the vanes. As such, the shape of the stator housing directly affects the loads the hydrodynamic bearing film 44 at the vane tip must support. In general, the less change in the radial distance from the center of the rotor to the stator housing wall, the less will be the variation in the centrifugal force component of the vane load support required of the vane tip hydrodynamic film. Further, the more uniform (or less variation in) the pressure loading, the more functional will be the selected shape for the vane tip over the entire inner periphery of the stator. Thus the stator housing inner wall contour design compliments the design of a successful vane tip shape.

The configuration I use for the stator housing inner wall 18 serves to complement the vane tip shape in a manner that minimized variations in the hydrodynamic film loading, while maximizing the displacement and volume change of the compressor. This is accomplished with stator housing inner wall shapes that are circular perturbations, elliptical in nature.

Cavity 12 is generally non-circular, having a slightly elliptical bias value ranging between 0.0 and 0.1, where the bias "e" is defined as $$e = \frac{a}{b} - 1$$

where the term "a" is equal to the length of the major axis of cavity 12, and the term "b" is equal to the minor axis of cavity 12. The surface of my preferred cavity is explicitly defined by the mathematical expression $$\frac{x^2}{a^2} + \frac{y^2}{b^2} = 1$$

where the terms "x" and "y" are Cartesian coordinates of any point on the surface of inner stator wall 18 of the cavity 12, the center of the coordinate system being at the geometric center of the cavity 12. The purpose of the non-circular cavity profile I prefer is to provide a large compressor displacement and a large volume ratio, with a corresponding large pressure ratio compared to a conventional circular cavity profile.

The axial length of the rotor and the axial length of the stator housing are substantially equal except for a small clearance 75 to allow free rotation of the rotor 14. The axial faces of the rotor are, therefore, in substantially close proximity with the end plates or end walls 27 and 28. In conventional rotary vane devices of similar size, the rotor is free to slide axially and contact the end plate. This contact causes drag and frictional losses in a random and uncontrollable manner, resulting in a shaft torque penalty. It also causes wear of the rotor and end plates and the generation of potential internal leakage paths. The mechanical restraint of the rotor 14 in accordance with U.S. Pat. No. 4,521,167 is herein retained, thus preventing the rotor from randomly contacting either end plate, thus minimizing drag and frictional losses and minimizing wear of the rotor and end plates.

As previously mentioned, the rotor 14 is fixed upon shaft 16. The fixation may be accomplished by any suitable method, such as a press fit, for example. With reference to FIG. 2, the shaft 16 is mounted in ball bearing 25 in a bore 35 in end wall 27, and in ball bearing 26 in a bore 36 in the other wall 28. Further, one end of shaft 16 extends axially outward through a seal housing 38 attached to end wall 28, this attachment being obtained such as by the use of suitable bolts. I prefer to use seals, such as O-rings, at the juncture between each significant member of the compressor housing.

The seal housing 38 incorporates a seal 48 for the prevention of gas and lubricant leakage from the compressor, such seal being of any suitable type such as the mechanical face variety. The housing 38 contains a suitably threaded hole 49 for the injection of lubricant to seal 48, bearing 26, and the vane surfaces of vanes 30 through 33.

The shaft 16 is constructed such that its portion passing through the rotor 14 has a larger diameter than that portion passing through the bearings 25 and 26, thereby forming shoulders 45 and 46. A suitable spring 56 is positioned on the shaft 16 between the bearing 26 and the shaft shoulder 46. On the opposite end of shaft 16, a shim 55 is positioned between the bearing 25 and the shaft shoulder 45. The outer race of bearing 25 is tightly fitted in the bore 35 of end wall 27, thereby limiting the axial movement of said outer race of bearing 25. Additionally, the rear housing 57 may be so constructed to further secure the axial movement of the outer race of bearing 25.

Similarly, the outer race of bearing 26 is tightly fitted in the bore 36 of end wall 28, thereby limiting the axial movement of this outer race. Also, the front seal housing 38 may be so constructed to further secure the axial movement of the outer race of bearing 26. The inner bore of bearing 25 and the inner bore of bearing 26 are of such a size as to permit a slightly loose fitting on shaft 16. Now, with the outer races of bearings 25 and 26 axially fixed, the shaft 16 and the rotor 14 thereto affixed become adjustable in an axial direction according to the thickness of shim 55. In general, the thickness of shim 55 is so sized to cause rotor 14 to be centered between the interiors of end walls 27 and 28, thereby eliminating undesired contact between the rotor 14 and the end walls during compressor operation. In some instances, however, the use of the shim may be eliminated.

The spring 56 is so sized to provide a sizable outward axial load on the inner race of bearings 25 and 26, thereby removing any axial play which may have otherwise existed in the bearings. Thus the axial position of the rotor and shaft assembly is positively fixed, and effectively constrained from axial displacement. It is understood that the above description is exemplary, and that modifications of the above technique for providing rotor axial restraint are possible in conjunction with my novel rotary vane compressor.

As previously mentioned, the shaft 16 contains a hole 17 concentric with the outer diameter of the shaft and extending axially for a substantial distance from the non-driven end of the shaft. The shaft 16 also contains a number of short radial holes which are mere extensions of radial holes or passages 40, 41, 42, and 43 contained in the rotor 14. In other words, latter radial holes intersect with the short holes disposed in shaft 16, which in turn connect to axial passage 17.

The rear seal housing 57 is attached to end wall 27, such as by the use of suitable bolts. Said housing contains a suitable threaded hole 58 aligning with shaft hole 17, the purpose of which is to provide an oil metering hole for lubricating oil to pass to the oil nozzles 50–53, previously mentioned. Housing 57 also contains a suitably threaded oil metering hole 59 for the purpose of injecting lubricant to bearing 25 and to the vanes. A seal 64 causes the two metering passages 58 and 59 to be isolated from each other, such that sufficient, but not excessive lubrication to the pertinent components can be assured.

As previously mentioned, the axis of rotation of rotor 14 is offset from the geometric center of the cavity 12 such that the outer diameter of the rotor comes into close proximity with the inner stator wall 18; note FIG.

1. Clearance between the rotor and the wall 18 is sufficiently small as to create an effective gas and oil seal between the suction and discharge sections of the compression chamber.

The vanes 30, 31, 32 , and 33 are each of identical construction, so that a description of one will suffice for all. The vanes have a width substantially equal to the rotor 14, and a thickness substantially equal to that of the vane slots. Each vane has a tip edge portion at its outer radial end which is adapted to sealingly engage the curved inner stator wall 18 during its traverse of said surface. The vane width is nominally 0.001 inches less than the width of the rotor. An oil film of 0.0005 inches per side will essentially reduce this vane end wall clearance almost to zero through the fluid seal that persists between each side of the vane and the two end walls.

More particularly, the shape of the vane tip I prefer is composed of two unequal, non-concentric radii, blending to form a generally smooth and unbroken surface profile. I prefer to use a vane tip having both a small radius and a large radius, and I prefer for the leading edge of the vane to be created at a large radius, whereas the trailing edge is preferably created at a small radius. The purpose of the compound vane radii is to provide a bearing surface which will develop substantial hydrodynamic support for the vane, thereby minimizing material contact between the vane tip and the inner stator wall 18, and thus minimizing wear.

Quite significantly, the vanes 30, 31, 32 and 33 have one or more radial grooves or passages on their forward faces, in each instance extending the full radial length of the vane. These radial grooves are of sufficient cross section to allow unobstructed communication between the gas in the vane base and the gas in the compression chamber. Typically, three or so grooves of passages of rectangular or semi-circular cross section are utilized, but I obviously am not to be limited to this number.

One purpose of these radial grooves is to provide an exit for gas that would otherwise be trapped within the vane slot and subsequently undergo compression, thereby creating excessive power penalties as well as excessive friction at the vane tips. In other words, I significantly reduce radial vane load by the use of the lightening holes and by using the radial grooves or passages in the obtaining of a suitable pressure balance across each vane.

A second purpose of these grooves is to make full use of the volume within the vane slot as a part of the gas compression process. Since the vane slot volume is free to communicate with the compression chambers defined between each adjacent pair of vanes, said volume thereby increases the displacement of the compressor without changing the remaining compressor geometry or speed of operation. A third purpose of these grooves is to allow oil to flow from the vane base region to the vane tip region.

By sizing the grooves or passages correctly, an effective fluid dynamic damper is created. The grooves or passages must not have a total cross sectional area that is so large as would permit a vane to lift off of the oil film 44, or experience bounce. A base pressure merely sufficient to prevent vane bounce is what I achieve by this advantageous design.

Figure 5:
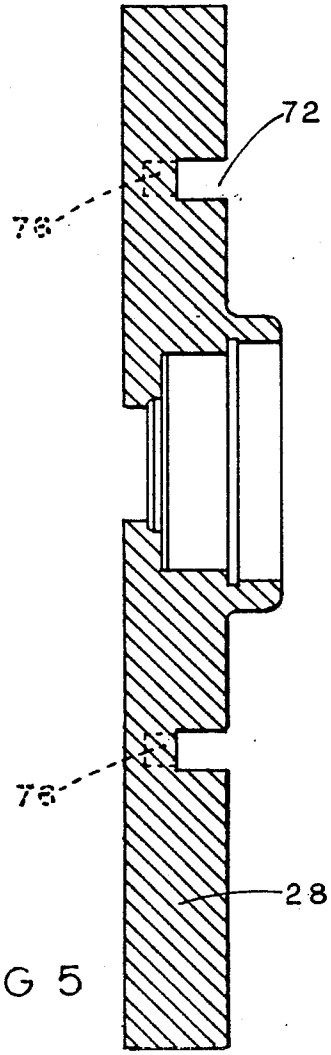
FIG. 5 is an edge view of a typical end plate in accordance with this invention, with particular reference to the circular groove to receive a sealing ring.

It was previously mentioned that in FIG. 3, one of the end plates of my device is depicted in detail, which may be end plate 28, with it there being shown that a circular groove 72 has been cut in the near face of the end plate. The sealing ring 70 is understood to reside in this circular groove, as was depicted in FIG. 2. In FIG. 5, a cross sectional view of a typical end plate is shown.

Shown in the circular groove 72 in FIG. 3 are a plurality of springs 74, disposed in respective recesses 76. FIG. 4B reveals spring detail to a larger scale. These springs are utilized to bias the ring 70 against the end surfaces of the rotor. As previously mentioned, each of the sealing rings 70 is made of very hard, tough steel, whereas the rotor usually has less hardness and toughness than the rings possess. The groove 72 is deep enough to enable the entire ring 70 to be accommodated, but as should now be clear, the evenly spaced series of springs 74 keep the ring 70 in continued contact with the rotor 14 during all operational circumstances of my compressor.

The spring rate is determined to counter the pressure area force on the outer facing seal ring surface. Typically, the internal pressure acting on the ring cross sectional area is the average between the suction and discharge pressure. This pressure times the ring normal area is used to determine the net spring force. The spring length, spring recess 76 and spring constant for each of the several locations is selected to give a net force slightly larger than this pressure area force so that the ring face is always in contact with the rotor side. A minimum number of springs, typically four or more must be used to evenly distribute the spring load in the circumferential direction to prevent the seal ring from cocking and therefore binding. The seal ring must also be structurally rigid so as not to deflect and therefore bind and the length of the ring must be of sufficient length to prohibit cocking.

I have found that in a relatively short period of operation, my device actually tends to "wear in" in a manner of speaking, and the relatively hard seal rings 70 in combination with the springs will actually find a seat in the near edge of the rotor, with this wear in process resulting in increased resistance to the establishment of a leakage path between inlet and outlet. This is, of course, because the initial small contact between the tapered seal ring and the rotor develops, with rotor wear, into a highly effective surface contact, as previously mentioned.

Although I am not to be limited to any particular dimensions, I prefer for the sealing rings 70 in the case of a 4 inch diameter rotor to have approximately a 4.0 inch outer diameter and a 3.5 inch inner diameter, with the rear edge of the ring, that is, the edge first entering the circular slot 72, having corner radii so as to prevent any tendency of binding.

Further details of the ring 70 are to be seen in the enlarged showing of FIG. 6A, which ring is of course received in the slot 72 of FIGS. 3 and 5. Further details of the circular slot 72 are to be seen in FIGS. 6 and **6*a*. An O-ring seal 78 is provided in a recess 79 located in the inner portion of ring 70**, to eliminate any blowby type leakage around the ring.

It is to be realized that the sealing ring 70 must be made sufficiently smaller than the end wall groove 72 for ease of assembly. This tolerance can lead to a leakage path around the ring, through the groove 72, so the O-ring 78 is provided in order to eliminate the possibility of leakage. The clearance between the seal ring 70 and seal ring groove 72 is large enough to allow for compression of the O-ring by 10% to 20%, which is a nominal acceptable value for O-rings.

As to the operation of my device, gas to be compressed is delivered to the compressor through the inlet ports or passages 24. Presuming that the rotor 14 is being driven in a clockwise direction when viewed in FIG. 1, a low pressure is brought about in said inlets, and subsequently a flow of gas into cavity 12 takes place. When the tip of each vane passes the end of inlet ports or passages 24, the gas and any lubricant mixed therewith is trapped in the moving chamber formed by the end walls 27 and 28, the stator inner wall 18 of cavity 12, the outer surface of rotor 14, as well as the vane just passing said inlet ports or passages, and the next following vane. As this chamber becomes smaller in volume due to the rotation of the rotor, the gas becomes compressed, in a well known manner.

Compression continues with the rotor rotation, until the leading vane of said chamber passes by the discharge passages or outlet ports 37. At this time, the compressed gas and lubricant mixture is pushed out of the compression chamber through the discharge passages 37 into any suitable manifold or collection tube.

The discharge passages or outlet ports 37 may each be equipped with an optional suitable reed valve, as is common practice, in which case the compressed gas and lubricant mixture will not exit the compression chamber until the pressure in said chamber has reached a level slightly exceeding that pressure level to which the compressor discharge is subjected.

As the rotor 14 is driven in rotation, the vanes 30–33, which are free to slide in their rotor slots 20–23 respectively, are urged outwardly by the centrifugal force acting thereon, and by the pressure of the compressed gas which is passed through the vane radial grooves. These forces are opposed by the hydrodynamic force created by the lubricant film established between the inner stator surface 18 of cavity 12, and the contoured end surfaces of the vanes, the placement of said film being further-described hereinafter.

The radial vane grooves also function to effectively minimize the radial forces said hydrodynamic film must support by relieving excessive pressure that would otherwise build up from compression of the gases in the vane slot, as the vane moves inwardly into its rotor slot, thereby effecting a near balance in the gas pressures across the radial direction of the vane.

The elliptical profile of inner stator wall 18 and the contoured tip surfaces of the vanes are so matched as to maintain a sizable radial hydrodynamic force at each vane tip, which is substantially maintained over the entire periphery of inner stator wall 18. Such hydrodynamic force minimizes friction losses and material wear, which normally occur in conventional rotary vane compressors.

The profile of inner stator wall 18 has other advantages not relating to said hydrodynamic support of the vanes. Such advantages include higher displacement and higher obtainable pressure ratio with a small diameter of vanes compared to conventional circular profiles. These advantages result solely from the geometric relationships between the rotor 14, its offset, and the profile of inner stator wall 18, said combination creating a relatively large suction volume and a relatively small discharge volume, with said volume change occurring over a larger arc of rotation.

As the compressor is operated, lubricating oil is discharged with the compressed gas. It is understood that this lubricant is subsequently separated from the discharge gas by some means externally located to the compressor, such as by a conventional oil separator, and that such lubricant is subsequently returned to the compressor by connecting tubes suitably attached to the oil inlet passages 49, 58, 59. Some oil may continue through the separator and not return to the compressor by said connecting tubes. In this case, it is assumed that this oil will eventually return to the compressor suction if the system in which the compressor is functioning is a closed system. If on the other hand, the system is an open one, it is assumed that the lubricant level in the separator will be replenished so that there is always a constant supply of oil to the oil passages 49, 58 and 59.

After passing through bearings 25 and 26, the lubricating oil inserted through the passages 49 and 59 then flows into the annular space formed by the shaft outer diameter and the shaft bores in the end walls 27 and 28. A portion of the oil then passes through the space 75 bounded by the side of the rotor 14 and the end walls, also lubricating the seal ring and rotor contact surfaces, and to some extent sealing these surfaces. This oil portion then flows into the gas compression chamber where it is subsequently discharged, separated, and then returned to the inlet passages 49 and 59 for a repeat cycle. The remaining oil portions enter the vane slots 20–23, thereby lubricating the sliding portions of the vanes 30 through 33. These oil portions then flow into the gas compression chambers where they are discharged, separated, and then returned to the previously mentioned oil inlets.

It is to be noted that pressure inside the housings 38 and 57 is lower than the discharge gas pressure, causing lubricant to flow into these housings without the assistance of an external pump. It is to be understood that the threaded holes 49 and 59 may contain a suitable orifice to restrict the oil flow to a desired level. Also, it is possible within the spirit of my invention to be able to control the flow of the lubricant by means of a suitable valve.

As the compressor is operated, lubricating oil is directed into threaded hole 58 of housing 57, thereby entering shaft oil passage 17, and thereafter radial oil passages 40–43. It is to be noted that this oil is delivered in controlled quantities to the dispersion nozzles 50–53 without significant restriction. These nozzles break up the oil into small particles, spraying these particles in a desired pattern across the respective compression chamber, and onto the inner stator wall 18. I have found that a desirable spray pattern is one which is flat and wide, and thus suitable for causing a uniform film of oil to be deposited across the entire axial dimension of the wall 18. The most advantageous spray pattern is obtained by proper selection of the nozzle orifice geometry. Also to be noted is the fact that the nozzles 50–53 also .function to meter the lubricating oil out at a desirable rate, such rate of flow being determined primarily by the size of each nozzle orifice, but such flow is cyclical, as will be explained shortly.

As a result of the lubricant being deposited on the inner stator wall 18, the vane tips subsequently pass over the lubricant film, thereby bringing about a hydrodynamic effect between vane tip contour and inner stator wall 18 that is quite advantageous. More specifically, the vane tips are caused to maintain a small distance away from the wall 18 of the cavity 12, which is sufficient to prevent material contact between the vane tips and the inner stator will over the entire portion of its circumference. In that way, component wear and friction are both minimized.

The gap or distance between a given vane tip and the inner stator wall 18 varies along the circumference of the wall in accordance with the radial load placed upon it by the vane tip. This variation may be calculated in accordance with conventional hydrodynamic bearing theory. This gap is normally filled with oil, thereby causing an effective gas seal that serves to prevent leakage between adjacent compression chambers.

The flow of lubricating oil through any one nozzle is dependent upon the pressure difference across the nozzle, such difference being caused by the oil delivery pressure and the chamber pressure. The oil supply pressure is assumed to be substantially constant, and equal to the compressor discharge pressure and the nozzle outlet pressure is equal to the particular compression chamber in which the nozzle is located. Consequently, the flow of oil through a given nozzle will be cyclical but repetitive during each revolution of the rotor 14. This transient flow pattern is affected by increasing chamber pressure as a chamber moves from the compressor suction region to the compressor discharge region, as a consequence of which, the oil flow decreases. Then, as the nozzle passes from the discharge region back to the region of the inlet passages 24, the oil flow is then increased.

These cyclical changes in oil flow are desirable in my invention inasmuch as the circumferential portion of cavity 12 receiving the maximum quantity of lubricant coincides with the regions of the cavity subject to maximum radial vane loads. These regions generally involve the suction portion (inlet passage area) of the cavity 12 . Additionally, the circumferential portion of the cavity receiving the minimum quantity of lubricant coincides with the region of the cavity subject to minimum radial loads generated by each vane, with this region generally comprising the discharge portion 37 of cavity 12. Thus, it is quite accurate to state that the means for supplying lubricant to the vane tips is consistent with varying load requirements of the hydrodynamic film located between the vane tips and the inner stator wall 18, and that the flow of lubricant from each nozzle 50–53 is intrinsically metered as a function of the angular position of the respective radial oil passage with regard to the location of the inlet passage area of my compressor.

My novel means of providing compressor lubrication have other, more subtle advantages. For example, precise placement of lubricant is automatically effected, thereby minimizing the random variations associated with prior art lubrication techniques. Also, the creation of lubricating films in accordance with my invention significantly reduces the quantity of lubricant required to be circulated through the compressor, thereby reducing oil contamination of the discharged gas, and also reducing the fouling of system components that may be attached to the compressor discharge.

I claim:

1. A low internal leakage, rotary vane gas compressor utilizing a housing having a generally elliptical cavity therein, whose outer boundary is defined by an inner stator wall, and a shaft mounted rotor disposed in said cavity, with the axis of rotation of said rotor being offset from the central axis of said cavity, an end plate on each end of said housing, each end plate having a centrally mounted hole for receiving the respective side of the rotor shaft, said housing having an inlet passage and a discharge passage, each in contact with said cavity, said rotor having a plurality of radial slots in which slidable vanes of minimal weight are disposed, with each vane being approximately the width of the rotor, and with the outer tip of each vane being in close proximity to said inner stator wall, said vanes serving to define a plurality of chambers that undergo significant volume changes as they move about said cavity during rotation of said rotor, said vanes thus cooperating with said inner stator wall and said end plates to compress gas entering said inlet passage, such that the gas is discharged at a higher pressure, said compressor utilizing a tapered seal ring mounted in each end plate, that rides on the respective side of said rotor, to effect an essentially zero gap therewith, each seal ring being of particularly hard, tough steel and because of its tapered cross section, the initial footprint area is comparatively small with a high loading, said small footprint area in effect serving as a type of cutting tool, to cause any line contact present between rotor and seal ring due to mutual misalignment to evolve, with rotor wear, into a surface contact.

2. The rotary vane gas compressor as defined in claim 1 in which each seal ring is spring loaded to give a positive bias on the respective side of said rotor.

3. A low internal leakage, rotary vane gas compressor utilizing a housing having a generally elliptical cavity therein, whose outer, boundary is defined by an inner stator wall, and a shaft mounted rotor disposed in said cavity, with the axis of rotation of said rotor being offset from the central axis of said cavity, an end plate on each end of said housing, serving as closure means for said cavity, each end plate having a centrally mounted hole for receiving the respective side of the rotor shaft, said housing having an inlet passage and a discharge passage, each in contact with said cavity, said rotor having a plurality of radial slots in equally spaced relation about its periphery, a slidable vane of minimal weight being disposed in each of said slots, with each vane being approximately the width of the rotor, and with the outer tip of each vane being in close proximity to said inner stator wall that defines the outer boundary of said cavity, said vanes serving to define a plurality of chambers in said cavity, which chambers undergo significant volume changes as they move about said cavity during rotation of said rotor, said vanes thus cooperating with said inner stator wall and said end plates to compress gas entering said inlet passage, such that the gas thereafter leaving through said discharge passage is at a higher pressure, and a tapered seal ring mounted in each end plate, that rides on the respective side of the rotor to effect an essentially zero gap therewith, each of said seal rings having a comparatively large diameter, and closely approaching in size the diameter of said rotor, thereby minimizing any tendency for leakage flow to occur between the adjacent chambers defined in said cavity by said vanes, each seal ring being of particularly hard, tough steel and because of its tapered cross section, the initial footprint area is comparatively small with a high loading, said small footprint area in effect serving as a type of cutting tool, to cause any line contact present between rotor and seal ring due to mutual misalignment to evolve, with rotor wear, into a surface contact.

4. The rotary vane gas compressor as defined in claim 3 in which each seal ring is spring loaded to give a positive bias on the respective side of said rotor.

5. The rotary vane gas compressor as defined in claim 3 in which a bearing is utilized in each end plate, to receive the respective end of the rotor shaft, and means for supplying lubricant to said bearings, with lubricant thrown out from said bearings under the influence of centrifugal force serving to lubricate the interface between seal ring and the respective side of said rotor, to minimize friction thereat.

6. The rotary vane gas compressor as defined in claim 3 in which said plurality of chambers at any given moment includes a high pressure discharge chamber, and a low pressure inlet chamber, and in which a contact area as opposed to a contact line exists between rotor and stator, to further reduce gas leakage between said high pressure discharge chamber, and said low pressure inlet chamber.

7. The rotary vane gas compressor as defined in claim 3 in which said inner stator wall at a location between said outlet and said inlet utilizes a radius concentric with said rotor, extending for a nominal length to define a portion of said inner stator wall.

8. The rotary vane gas compressor as defined in claim 4 in which each seal ring is equipped with an O-ring to prevent compressed gas infiltrating behind said seal ring.

9. The rotary vane gas compressor as defined in claim 4 in which said seal ring is of sufficient dimension to prevent ring misalignment or cocking due to an uneven load.

10. A low internal leakage, rotary vane gas compressor utilizing a housing having a generally elliptical cavity therein, and a shaft mounted rotor disposed in said cavity, with the axis of rotation of said rotor being offset from the central axis of said cavity, said housing having an inlet passage and a discharge passage, each in contact with said cavity, said rotor having a plurality of radial slots in equally spaced relation about its periphery, a slidable vane of minimal weight and approximately of rotor width disposed in each of said slots, with the outer tip of each vane being in close proximity to an inner stator wall that defines the outer boundary of said cavity, an end plate secured on each end of said housing, said end plates serving as closure means for said cavity, each end plate having a centrally mounted hole for rotatably receiving the respective side of the rotor shaft, said vanes serving to define a plurality of chambers in said cavity, which chambers undergo significant volume changes as they move about said cavity during rotation of said rotor, said vanes thus cooperating with said inner stator wall and end plates to compress gas entering said inlet passage, such that the gas thereafter leaving through said discharge passage is at a considerably higher pressure, said plurality of chambers at any given moment including a high pressure discharge chamber, and a low pressure inlet chamber, and in which a contact area as opposed to a contact line exists between rotor and stator, to further reduce gas leakage between said high pressure discharge chamber and said low pressure inlet chamber, and a seal ring operably mounted in each end plate, that rides on the respective side of the rotor to effect an essentially zero gap between the rotor side and the seal ring, each seal ring being of particularly hard, tough steel and having a tapered cross section such that the initial footprint area is comparatively small with a high loading, said small footprint area in effect serving as a type of cutting tool, to cause any line contact present between rotor and seal ring due to mutual misalignment to evolve, with rotor wear, into a surface contact, each of said seal rings having a comparatively large diameter, and approaching in size the diameter of said rotor, there by minimizing any tendency for leakage flow to occur between the adjacent chambers defined in said cavity by said vanes.

11. The rotary vane gas compressor as recited in claim 10 in which both of said seal rings are evenly biased to bring about close contact with the respective sides of said rotor.

12. The rotary vane gas compressor as defined in claim 10 in which a bearing is utilized in each end plate, to receive the respective end of the rotor shaft, and means for supplying lubricant to said bearings, with lubricant thrown out from said bearings under the influence of centrifugal force serving to lubricate the interface between seal ring and the respective side of said rotor, to minimize friction thereat.

13. The rotary vane gas compressor as defined in claim 10 in which said inner stator wall at a location between said outlet and said inlet utilizes a radius concentric with said rotor, extending for a nominal length to define a portion of said inner stator wall.

14. The rotary vane gas compressor as defined in claim 11 in which each seal ring is equipped with an O-ring to prevent compressed gas infiltrating behind said seal ring.

15. The rotary vane gas compressor as defined in claim 11 in which said seal ring is of sufficient dimension to prevent ring misalignment or cocking due to an uneven load.

* * * * *